US006945064B2

(12) United States Patent
Jebaraj

(10) Patent No.: US 6,945,064 B2
(45) Date of Patent: Sep. 20, 2005

(54) SELF-CONTAINED AIR-CONDITIONED ENCLOSURE

(76) Inventor: Asir Iyadurai Jebaraj, 12500 Hickory Hollow Dr., Oklahoma City, OK (US) 73142

( * ) Notice: Subject to any disclaimer, the term of this patent is extended or adjusted under 35 U.S.C. 154(b) by 9 days.

(21) Appl. No.: 10/038,255

(22) Filed: Jan. 2, 2002

(65) Prior Publication Data

US 2002/0121101 A1 Sep. 5, 2002

(51) Int. Cl.[7] ..... F25D 23/12
(52) U.S. Cl. ..... 62/259.1; 62/371
(58) Field of Search ..... 62/259.1, 371, 62/440, 428, 237

(56) References Cited

U.S. PATENT DOCUMENTS 3,633,324 A * 1/1972 Cuylits ..... 52/66
4,309,999 A * 1/1982 Luedet ..... 128/371
4,512,120 A * 4/1985 Lindal ..... 52/79.1
4,860,642 A * 8/1989 Nussbaum ..... 98/40.19
5,148,767 A * 9/1992 Torchio ..... 119/484
5,619,864 A * 4/1997 Reedy ..... 62/428
5,725,426 A * 3/1998 Alvarez ..... 454/187
5,740,790 A * 4/1998 Lipsky ..... 126/113
5,799,652 A * 9/1998 Kotliar ..... 128/205.11
5,988,264 A * 11/1999 Goldsmith ..... 165/48.1
6,065,296 A * 5/2000 Feger ..... 62/77
6,070,372 A * 6/2000 Norman et al. ..... 52/71

* cited by examiner

*Primary Examiner*—Melvin Jones

(57) ABSTRACT

A Self-Contained Air-Conditioned Enclosure; comprises of an Enclosure (1), connected through plurality of openings (13,14) to air ducts (20,21) of an Air-conditioning Unit (17). The Enclosure has a Roof (5), and sidewalls assembled with plurality of Wall Sheets (8) interspaced with Spacer Strips (9) to enhance thermal resistance of the sidewalls. The bottom of the sidewall is inserted under the structure that forms the floor to create an isolated enclosure. The Air-conditioning Unit (17) supplies the Enclosure through the Supply Air Duct (21) and withdraws air through Exit Air Duct (20). Part of the withdrawn air is reconditioned and supplied to the enclosure; the other part is replaced by fresh air. Energy is conserved from the replaced air in Heat Transfer Duct (37) and transferred to fresh air in Fresh Air Chamber (36). Unit efficiency is improved by mixing the exhausted withdrawn air in the Compressor Chamber (31) and exhausted by the Exhaust Air Duct (28). Flow of fresh air is controlled through the Air Damper (39) and Control Knob (38).

16 Claims, 3 Drawing Sheets

SELF-CONTAINED AIR-CONDITIONED ENCLOSURE

CROSS-REFERENCE TO RELATED APPLICATIONS

Not applicable

BACKGROUND

1. Field of the Invention

This Invention relates to as comfort Air-conditioning, specifically to an air-condition apparatus to provide an air-conditioned enclosure for indoor or outdoor use that is compact and portable.

2. Description of Prior Art

Air-conditioning of space with units employing refrigerants are used for cooling space for personal comfort. Commercial air-conditioners have the following disadvantages:

(a) Higher Capital investment in the space to be air-conditioned: For effective and efficient use of Air-conditioning requires a room or a building to be built with thermal insulation, air infiltration seals, shaded windows and other special requirements. Such special requirements result in higher capital investment in addition to the cost of the air-conditioner.

(b) Higher Capital investment for larger air-condition unit: The minimum space that could be effectively air-conditioned using the traditional air-condition unit is an entire room, even if conditioning is required only for a portion of the room that is occupied. Commercial portable air-conditioners have the same limitation. The larger the space to be air-conditioned the larger is the air-condition unit required. Larger the unit higher the cost. For example in a bedroom, the minimum space that requires air-conditioning is the compact space surrounding the body of the occupants. In current application, the entire bedroom needs to be air-conditioned. This will result in unnecessary extra cost of larger equipment and installation.

(c) Higher Operation cost: As discussed in previous paragraphs traditional units would be of larger capacity than the minimum needed for specific applications. Larger the unit higher is the operating cost for electric energy. Cooling of a selective smaller space offers comfort at a lower operational cost. A selected enclosure could be cooled with commercially available portable air-conditioner however the disadvantage is the portable air-conditioner can not supply cooled fresh air but only re-circulates the space air.

(d) Enclosures available for clean air requirements such as Michael H. Pelosi, III et al U.S. Pat. No. 5,314,377 is not suitable for comfort Air-conditioning of a compact space, as it requires an independent source of conditioned air in the place of the clean air source. In addition, the prior art enclosure has cumbersome structure requiring complex assembly. The objective of that enclosure is to provide clean air and not comfort conditioning, so major modification is necessary before it can be used for comfort air-condition application.

Commercially available portable air-conditioner can cool an enclosed space however the disadvantage is it cannot supply cooled fresh air but can only re-circulates the space air. Thus, none of the current apparatuses is suitable for providing an air-conditioned enclosure.

Air-conditioned Mosquito net of patents such as San Jianhua et al China. Pat. No. CN2259099 and Tan Mingsen et al China. Pat. No. CN1163735 illustrates mosquito nets connected to a conditioned air source by an air duct. Both of these prior art requires an external source of conditioned air. In addition, in both of these prior arts, outside air is conditioned and supplied to the enclosure and all of the air is exhausted outside the enclosure. 'Heat Insulating Mosquito-Net' of He Baoan et al China. Pat. No. CN1061140 illustrates a mosquito net with plurality of inflatable air-pocket walls. This art has the disadvantage of requiring inflation of wall air pockets and increases the chance of failure of thermal insulation due to puncturing of the air pockets. cl SUMMARY In accordance with the principles of the present invention there is an air-conditioned enclosure assembly comprising of a portable Air-conditioning Unit and a connected Enclosure to provide an air-conditioned enclosed space with fresh air supply, that is self-contained, portable and modular.

Objects and Advantages

Accordingly, besides the objects and advantages of original air-condition apparatus, several objects and advantages of the present invention are:

(a) to provide a portable space enclosure assembly for personal comfort, at desired temperature, humidity and filtered fresh air;

(b) to provide personal comfort at economical initial cost, as the air-condition unit can be smaller in capacity to condition a small occupied space;

(c) to provide personal comfort at economical operating cost, as conditioning of only the occupied space requires less electric energy;

(d) to provide energy conservation through re-circulating a part of the enclosure air;

(e) to provide cooled or heated fresh air to offer better air quality for the occupants;

(f) to provide energy conservation by pre-cooling the fresh inlet air with the cool exhaust air. The same applies for heating too;

(g) to provide control over the quantity of fresh air using air damper;

(h) to improve the efficiency of the system by using the exhaust air for the condenser coil cooling;

(i) to provide an air-conditioned personal space for both indoor and outdoors use;

(j) to provide reduced initial cooling time from the start of cooling to achieve the comfort temperature. The same applies for heating too;

(k) to provide comfort air-conditioning without requiring special building construction requirements such as thermal insulation, air infiltration seals, shaded windows and others;

(l) to provide an enclosure for quick assembly using widely available materials;

(m) to provide a dedicated Air-conditioning Unit to provide comfort in the enclosed space The process of air-condition referred in this invention generally refers to heating or cooling, humidification or dehumidification, and filtering of air for comfort. Further objects and advantages are to provide economical personal comfort through reduced initial cost; reduced operating cost, portability, and targeted space cooling for a specified time. Still further objects and advantages will become apparent from a consideration of the ensuing description and drawings.

DRAWING FIGURES

Figure 1:
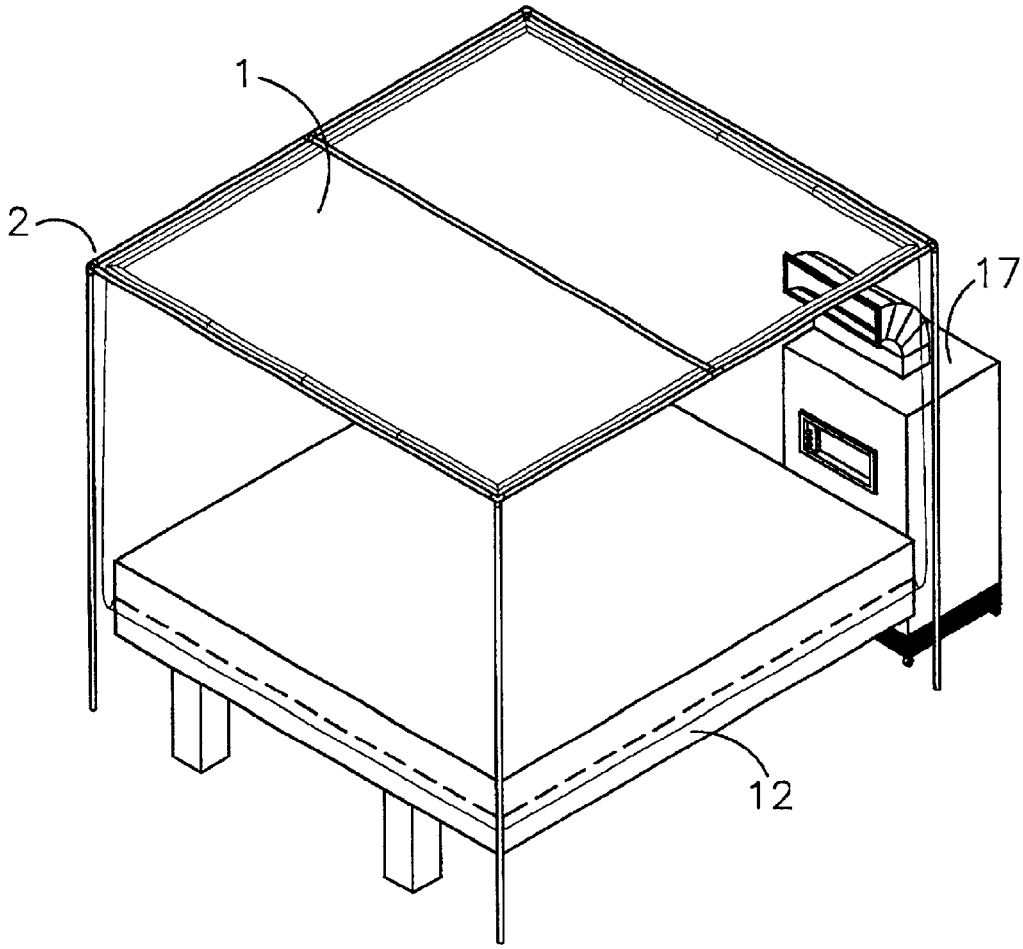
FIG. 1 shows the perspective view of the Self-Contained Air-conditioned Enclosure.

| Reference Numerals in Drawing | |
|---|---|
| 1 | Enclosure |
| 2 | Frame Structure |
| 3 | Frame Member |
| 4 | Corner Connector |
| 5 | Enclosure Roof |
| 6 | Roof Lip |
| 7 | Support Strap |
| 8 | Enclosure Wall Sheet |
| 9 | Spacer Strips |
| 10 | Shield |
| 11 | Clip |
| 12 | Bed Mattress |
| 13 | Exit air opening |
| 14 | Supply air opening |
| 15 | Exit air opening rim |
| 16 | Supply air opening rim |
| 17 | Air-condition Unit |
| 18 | Housing |
| 19 | Castor |
| 20 | Exit air duct |
| 21 | Supply air duct |
| 22 | Channel Seat |
| 23 | Air Plenum |
| 24 | Fan Motor Assembly |
| 25 | Air Filter |
| 26 | Evaporator Coil Assembly |
| 27 | Blower Assembly |
| 28 | Exhaust air duct |
| 29 | Air intake Hood |
| 30 | Condensing Coil Bank |
| 31 | Compressor Chamber |
| 32 | Compressor |
| 33 | Air Grill |
| 34 | Temperature Control |
| 35 | Temperature Gauge |
| 36 | Fresh Air Chamber |
| 37 | Heat Transfer Duct |
| 38 | Fresh Air Control Knob |
| 39 | Air Damper |
| 40 | Control Rod |
| 41 | Control Panel |

DESCRIPTION OF THE INVENTION

Preferred Embodiment

A preferred embodiment of the Air-Conditioned Enclosure of the present invention is illustrated in FIG. 1. The Air-Conditioned Enclosure comprises of an Enclosure 1, which is structurally supported by a skeleton or Frame 2, and connected through plurality of openings to air ducts of an Air-conditioning Unit 17. The Enclosure is shown in FIG. 1 as assembled over a bed with mattress 12.

Figure 2:
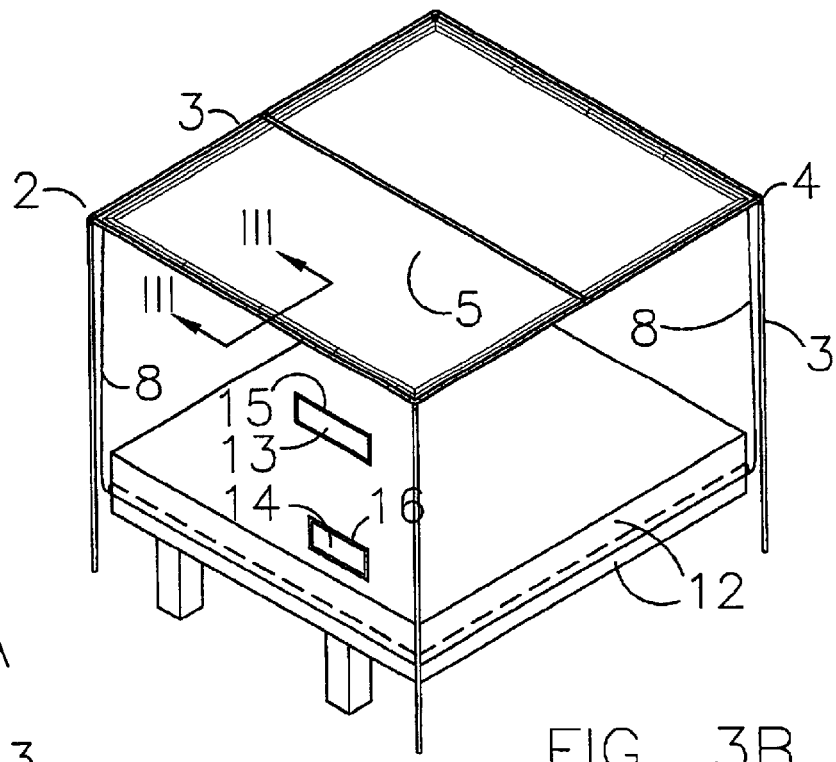
FIG. 2 shows the perspective view of the Enclosure.

FIG. 2 shows the said Frame 2, assembled with beams, pylons or Frame Members 3, and preferably made of tubes of suitable size and material. The Frame Members 3, form a rectangular configuration and have plurality of vertical extensions or legs. In the preferred embodiment, the Frame Members are telescoping plastic tubes assembled with Corner Connectors 4. The Corner Connector 4, support and connect three of the Frame members 3, to structurally form the corner of the said Frame 2. The Corner Connector 4, is a three-dimensional socket to receive three of the said Frame Members 3, two of the said Frame Members that are perpendicular to each other and forms two sides of the said rectangular configuration and another Frame member that forms a leg, vertical to the said rectangular configuration. The Enclosure has a cornice, top or Roof 5, preferably constructed of suitable translucent lightweight rigid board with insulation properties. One sidewall of the said Enclosure has Openings 13 and 14 to accommodate Air Ducts of the Air-conditioning Unit. The above said openings have elastic Rims 15 and 16.

Figure 3A:
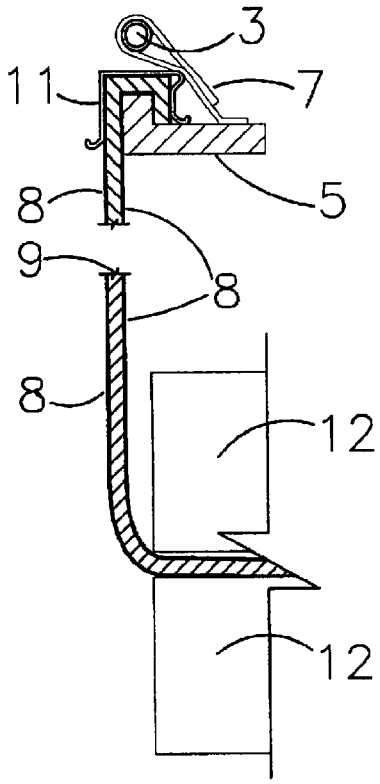
FIG. 3A shows the partial section view along line III—III of FIG. 2.

FIG. 3A illustrates the section view of the Enclosure sidewall assembly and its support facilities and jointing arrangements made available in the invention. The Roof 5 has a vertical rim around it and plurality of attached Support Straps 7 of suitable size, strength and material. The said Support Straps are used to suspend the said Roof from the said Frame. The said Support Straps wraps around the said Frame Members 3 forms a loop and fastens on to itself, preferably using hook-and-loop fastener. The sidewalls of the Enclosure are made of plurality of Enclosure Wall Sheets 8, made of suitable material that is transparent, flexible, lightweight and having good thermal properties, preferably plastic sheet.

Figure 3B:
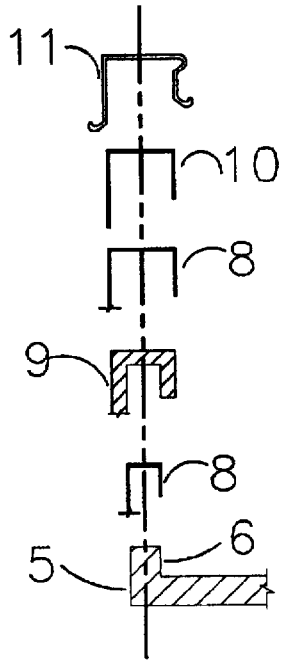
FIG. 3B shows the exploded partial section view of the Roof and enclosure sidewall assembly of FIG. 3A.

FIG. 3B shows an exploded partial section view of the Roof and Enclosure sidewall assembly of FIG. 3A. FIG. 3B shows the vertical rim or Lip 6 of the Enclosure Roof 5. There is plurality of thin Spacer Strips 9, of suitable thickness, flexible, lightweight, and preferably translucent strips of foam sheet or sponge. The Spacer Strips 9 are located between the above said Sheets 8, at sufficient intervals. This arrangement forms air space or pockets between the Sheets, to enhance the thermal resistance of the Enclosure wall assembly.

FIG. 3B also shows the method of fastening the Enclosure sidewall to the said Roof 5. The said Sheets 8, and Spacers 9, are overlaid to cover the top portion of the Roof Lip 6. The said Sheets and the said Spacer are covered by plurality of covers or Shield 10, and held by plurality of clevis or Clip 11. The Shield's function is to cover the said Sheets 8, and Spacers 9, and protect against damage from the Clip 11. In the preferred embodiment, there are four Shields, one on each side of the Enclosure Roof 5. The Clip 11 is made of suitable material preferably metal.

The lower portion of the Enclosure wall assembly comprised of Sheets 8, and Spacer Strips 9, is tucked or inserted under the structure that forms the floor. For example in when the Enclosure is used over a bed, the floor is formed by the mattress 12 and the Enclosure walls are tucked under the mattress to form a good air tight Enclosure as shown in FIGS. 1, 2 and 3A.

Figure 4:
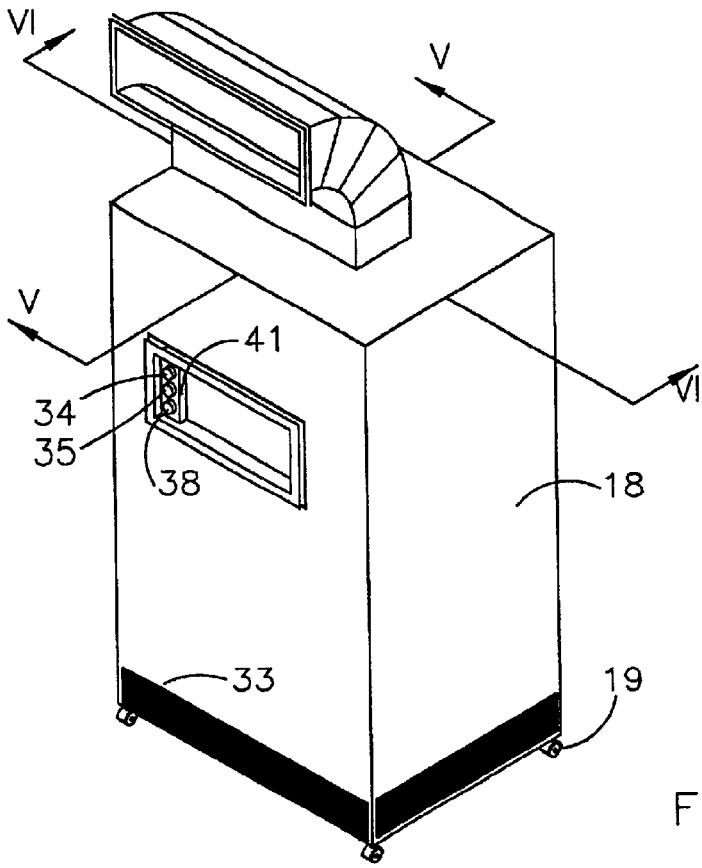
FIG. 4 shows the perspective view of the Air-conditioning Unit.

FIG. 4 illustrates the perspective view of the Air-conditioning Unit 17. The said Air-conditioning Unit 17 has traditional air-conditioner parts such as compressor, evaporator coil, condenser coil, air filter, fan, blower, motors and controls. The said unit 17, has a housing or a body 18, of suitable material preferably plastic exterior or walls, and structurally supported by steel frames. Attached to the bottom of the housing is plurality of wheels or castors 19 for mobility of the Unit.

The air-conditioner unit includes a Control Panel 41, located on the front side of Unit. The control panel consists of a Temperature Control 34, a Temperature Gauge 35, and a Fresh Air Control Knob 38. At the bottom of the Unit 17, plurality of Air Grill 33 is located. The portion of the Air Grills on the walls of the Compressor Chamber 31, supplies outside air to the Compressor Chamber.

Figure 5:
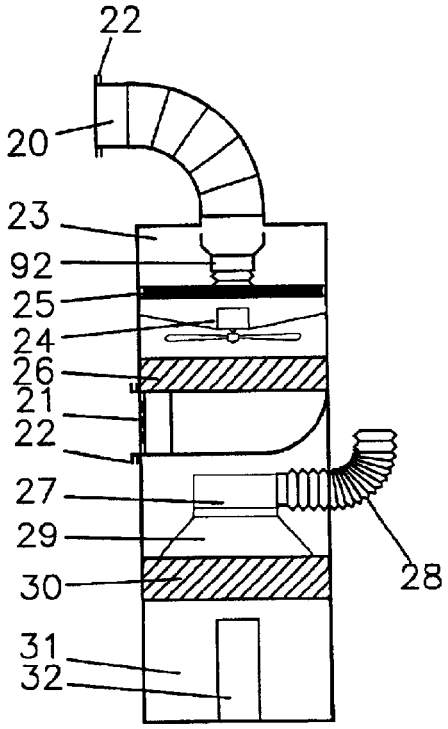
FIG. 5 shows the side section view along line V—V of FIG. 4.
Figure 6:
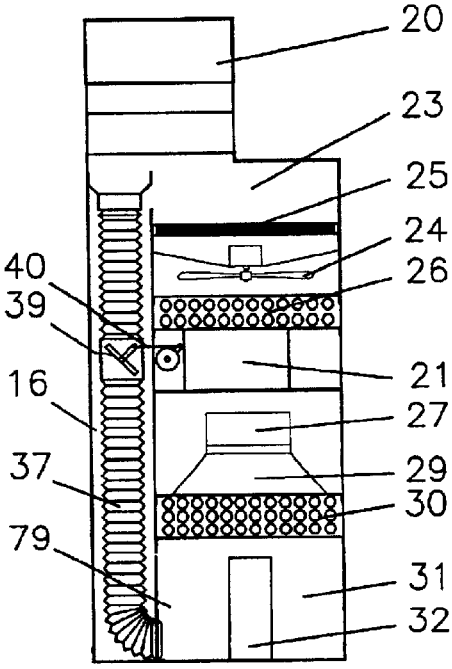
FIG. 6 shows the front elevation section view along line VI—VI of FIG. 4.

FIGS. 5 and 6 shows cross section views of the Air-conditioner Unit 17. There is an Exit Air Duct 20, connected preferably to the top of the housing 18. There is a Supply Air Duct 21, on one side of the said housing 18. The above said Exit Air Duct 20 is made of suitable material to be flexible, collapsible and both the said ducts are preferably constructed with thermal insulation. The said ducts 20 and 21, have plurality of lips at the extremity to form a narrow channel 22, within which the respective elastic rims of the Enclosure 15 or 16, shown in FIG. 2, sits and forms an airtight connection between the said Enclosure 1 and the Air-conditioning Unit 17.

The Exit Air Duct 20 connects to an Air Plenum 23. At the lower part of the Air Plenum, an Air Filter 25 is located. An air moving device such as a Fan Motor assembly 24, consisting of a fan, a motor and structural support is located below the said Air Filter. Below the Fan Motor Assembly is located the Evaporator Coil Assembly 26. In the preferred embodiment, Evaporator Coil Assembly consists of a refrigerant evaporator coil bank and may include an electric heating element. Below the said evaporator coil assembly is the Supply Air Duct 21.

Next and below the Supply Air Duct 21, is located a fan or blower assembly 27. Note that fans and blowers generally refer to any air-moving device and can be used interchangeably in this preferred embodiment. The said blower assembly consists of the blower, motor, air intake hood, housing and other essential elements. The blower has an Exhaust Air Duct 28 attached to its side and extends through the backside of the unit's housing 18. The exhaust Air Duct 28 is preferably flexible, collapsible, lightweight and round duct structure. The blower assembly has an air intake hood 29, it is rectangular prism shaped with the smaller end transitioning to a circular shape and attached to the blower. The lower end of the intake air hood 29 is sized to cover the top of the condensing coil bank 30.

Next and below the blower is a Condensing Coil Bank 30, for condensing the refrigerant vapor. Below the Condensing Coil Bank is a space, volume or Compressor Chamber 31. The lower portion of the Compressor Chamber, which is also the lower portion of the housing have plurality of Air Grills 33. Contained within the compressor chamber is a refrigerant compressor assembly 32. The compressor assembly includes a hermetic refrigerant compressor, motor and necessary electrical and control elements. The chamber may also house required electric circuit, control system circuit, voltage stabilizer and other auxiliaries. The said compressor is connected to the evaporator coil assembly 26, and the condenser coil bank 30, with metal tubes of suitable material and size.

FIG. 6 shows a space or Fresh Air Chamber 36, a rectangular prism shaped volume located on one side of the unit that extends up to the Air Plenum 23 at the top and to the bottom of the Unit 17. The Fresh Air Chamber 36 also has the said Air Grills 33, at the bottom that supplies outside air to the Enclosure. The said Fresh Air Chamber 36 is thermally insulated and does not have air communication with the Compressor Chamber 31.

Inside the Fresh Air Chamber 36, is a Heat Transfer Duct 37, which is preferably flexible, collapsible, lightweight and round or rectangular duct structure with good heat transfer property. At the same level or height of the control Panel, there is an Air Damper 39 in the Heat Transfer Duct 37 connected to the Control Knob 38 with Control Rods 40 and links. The said Air Damper 39 is a butterfly valve type damper to control airflow inside the Heat Transfer Duct 37. The Heat Transfer Duct is connected at the top with the Air Plenum 23, and at the bottom end it is connected to the Compressor Chamber forming an air passage between the Air Plenum and the Compressor Chamber. Finally, there is an electric cord with connector to connect with an electrical power source or a wall outlet.

Advantages

According to the invention, there is provided an Air-Conditioned Enclosure assembly comprising of

- a portable Air-conditioning means and
- a connected Enclosure to provide an air-conditioned enclosed space, with fresh air supply said Enclosure comprising of:

a. an Enclosure suitable to be fitted on to any flat surface.
b. Frame—means to support the Enclosure structure and assembled with frame members.
c. Roof—means of light board structure with vertical rim or lip along the periphery.
d. Support straps means on the roof to suspend the said roof onto said frame.
e. Sidewalls—means plurality of plastic sheets along with spacer strips.
f. Roof lip, shield and clip means—to hold the sidewalls onto the said Roof.
g. Openings in Enclosure means to accommodate air ducts of air-conditioning unit.
h. Air-conditioner means—for cooling the Enclosure.

and said Air-conditioning means comprising of:

(i) a main housing.
(ii) an exit air duct connected on the top of the said housing.
(iii) an Air Plenum connected to the said exit air duct.
(iv) an air filter is located at the bottom of the said Air Plenum.
(v) a fan motor assembly is located at the bottom portion of the said Air Plenum next to the said Air Filter.
(vi) an evaporator coil assembly is fixed below the said air filter.
(vii) a supply air duct is connected on one side of the said housing and below the said evaporator coil assembly.
(viii) a fan blower assembly connected below the said supply air duct.
(ix) an exhaust air duct is attached to the said fan-blower assembly on its side and extends through the backside of the said housing.
(x) a condensing coil bank is fixed below the said blower.
(xi) a compressor chamber is fixed below the said condensing coil bank.
(xii) a control panel located on the side of said supply air duct.
(xiii) Fresh Air Chamber inside the housing extending from the bottom to the Air Plenum at the top and has air grills at the bottom.

The Enclosure may have one of several shapes such as rectangle, square, cylindrical or a combination thereof.

Various types of air-condition may be generally referred to but the invention is particularly adapted to a process of heating or cooling, humidification or dehumidification and filtering of air only.

The invention comprising of an Enclosure and an air-condition unit can be fitted on to any flat surface. In the embodiment described, the frame of the Enclosure is structurally fitted onto the floor surface and the wall sheets tucked at the floor level under the structure that forms the floor. This forms a good airtight Enclosure, which is thermally isolated.

The one sidewall of the Enclosure has two openings with elastic rims to accommodate air ducts i.e. exit air duct and supply air duct of the Air-conditioning Unit.

The Air-conditioning Unit has the traditional parts such as compressor, evaporator coil, condenser coil, air filter, fans, motor, controls and others assembled as described in the preferred embodiment to supply fresh air and re-circulated cool air to the said Enclosure of the preferred embodiment.

The present invention provides a portable airtight Enclosure system with openings for receiving the Air-conditioning ducts and an Air-conditioning Unit for providing a suitable clean, cool and conditioned atmosphere, within the said Enclosure system. The Enclosure system can assume various shapes suitably in accordance with the shape of the frame, which is the structural support for the said Enclosure. In the preferred embodiment of the present invention, there is provided a rectangular system comprising a hard board roof with soft sheet walls thus ensuring insulation on all sides.

In accordance with the present invention there is provided a method for providing a suitably conditioned Enclosure which comprises of using an air-conditioner means which comprises the steps of enclosing a volume of air in the Enclosure filtering and conditioning fresh air and supplying the conditioned air to the said Enclosure, and exhausting the air from the Enclosure.

Advantages of this system are that it provides for a simple, portable, economical, enclosure system, which is easy to manufacture and sell and equally easy to assemble and to dismantle when not in use. The Air-conditioning Unit also provides for energy conservation by pre-cooling/pre-heating the fresh inlet air with the cool/hot exhaust air. In addition, the condenser coil cooling is enhanced by using the exhaust air. The present invention as a whole is inexpensive, more compact, more efficient and portable.

Another example of the Enclosure structure similar to the one described herein above is to have the following:

As an extension of scope of invention, a typical example is to have a single pre-fabricated foldable enclosure—comprising of framework including the roof, the sidewall sheets and spacer strips. This is simple to avoid the assembly work involved in the preferred embodiment herein above described in the previous paragraphs.

The Enclosure is pre-fabricated with the wall sheets and spacer strips including a roof portion and drapes over the frame structure. One side of the wall may be provided with re-sealable opening for people passage preferably with hook and loop fasteners.

Working of the Invention

The working of the invention is herein described in detail. The said Enclosure assembly 1, creates an isolated air space above an occupied surface, an example of such an application is around a bed as shown in FIG. 1.

The Enclosure isolates the inside space from the outside thermally and avoids outside air infiltration. The said air opening rims 15 and 16, wrap around the said Air Ducts, and offers air passage or connection with the Air-condition Unit 17. The Enclosure assembly is structured to be lightweight, to cost less, and to offer quick and easy assembly and disassembly; thus offering portability.

Enclosure air is drawn through the Exit Air opening 13 and Exit Air Duct 20. Part of the air from Exit Air Duct 20 and Fresh air from Fresh Air Chamber 36 is mixed in the Air Plenum 23. The air is filtered through the Air Filter 25 and is moved by fan 24 through the Evaporator Coil Assembly 26, where it is conditioned. The conditioned air enters the Enclosure through the Supply Air Duct 21.

Part of the Exit air from duct 20 passes through the Heat Transfer Duct 37 to Compressor Chamber 31. The Air Damper 39 controls the flow of air inside the Heat Transfer Duct 37. Air Damper 39 is adjusted by the Control Knob 38 interconnected by Control Rods and links 40. The air in duct 37, pre-conditions, pre-cools or pre-heats the fresh air in the Fresh Air Chamber 36. This pre-conditioning of the fresh air by the exhaust air conserves energy. The Fresh Air chamber is supplied by fresh air through the Air Grills 33 located at the bottom.

Outside air is also drawn inside the compressor chamber 31, through the air grills at the lower portion of the said Chamber. Air from the Heat Transfer Duct 37, enters the said chamber 31, mixes with air in the chamber, and is moved by the blower 27. The blower moves the air mixture across the condenser coil assembly 30, and exhausts it through the exhaust duct 28. The exhaust duct's free end may be located to exhaust hot air outside of the building through a window or doorway if the invention is used indoor. For outdoor use the exhaust duct can exhaust to the space.

Conclusions Ramifications and Scope

The above description illustrates the Self-contained Air-Conditioned Enclosure provides air-conditioned comfort with fresh air at economical capital cost, conserves energy, operates with lower cost, is portable can be assembled easily and has longer life.

While the above contains many specifications these should not he construed as limitations on the scope of the scope of the invention, but rater as an exemplification of one preferred embodiment thereof. Many other variations are possible a few examples follow.

The rigid Enclosure Roof of the enclosure can replaced with an assembly similar to the sidewalls, with Wall Sheets and Spacer Strips. The Enclosure Frame structure instead of located outside the enclosure could be placed inside and support the enclosure. The Enclosure can be colored and have other shapes such as circular, square or combination thereof. The Enclosure sidewall can have slit opening for entry or exit to the Enclosure that can be sealed and fastened by hook-and-loop fasteners etc.

The components of the Air-condition Unit can be rearranged to serve the same purpose as this invention. The Air moving devises can be connected with a longer shaft driven by a single electric motor. The air-conditioner or its control can be modified to work as a heat pump. The Unit size can be compacted by eliminating the Fresh Air Chamber and Heat transfer duct at the expense of energy conservation.

Thus the scope of the invention should be determined by the appended claims and their legal equivalents, rather than by the examples given.

I claim:

1. A self-contained air-conditioned enclosure assembly providing a comfortable personal environment for occupants comprising:

a. an enclosure assembly means having an interior, suitable to be fitted on a slab, whereby thermally confining the interior space above said slab, and said slab having an underside, b. a frame means for structurally supporting said enclosure, comprising plurality of frame members and plurality of corner connector means for interconnecting said frame members, c. a roof disposed in spaced relation above said slab having a plurality of support straps for suspending said roof from said frame means, d. a plurality of upright sidewall means attached to said roof comprising a plurality of well sheets and a plurality of spacer strips, said sidewall means having an upper portion and a lower portion, e. a plurality of first means for securing the upper portion of said sidewall means to said roof, f. an exit air opening in said sidewall means, g. a supply air opening in said sidewall means located vertically at a substantial distance below said exit air opening, h. an air-conditioner means for conditioning the interior space of said enclosure, comprising:

i) a main housing having four vertical sides, a cornice, a floor and an interior space, ii) an air plenum located in said main housing bounded on top by the cornice of said main housing and having a mid portion and a bottom end, iii) an exit air duct means extending from the cornice of said main housing, communicating with said air plenum, having an extremity that is connected to said exit air opening for conveying air exiting the enclosure to said air-conditioner means, iv) a first air moving devise such as a fan motor assembly located within said air plenum for inducing air movement from said enclosure to said air-conditioner, v) a heat transfer means comprising an evaporator coil and a heater element assembly, fixed below said air moving devise at the bottom end of said air plenum, whereby air moved by said first air moving devise through said heat transfer means is thermally conditioned, vi) a supply air duct means extending horizontally from one side of said main housing located below said heat transfer means having four walls, an extremity that is connected to said supply air opening, and the bottom wall of said supply air duct means extends inside said main housing thereby horizontally partitioning said main housing whereby conditioned air from said heat transfer means is conveyed to the enclosure, vii) a second air moving devise such as a fan blower assembly fixed below the bottom wall of said supply air duct, viii) an exhaust air duct connected to said second air moving devise and extends through one of the sides of said main housing on the opposite side of said supply air duct means, ix) a condensing coil bank fixed below said second air moving devise whereby heat is rejected from said condensing coil bank to the air moved by said second air moving devise, x) a compressor chamber located below said condensing coil bank having a compressor fixed on the floor of said main housing, isolated from said air plenum by the bottom wall of said supply air duct means, xi) a control panel attached vertically at the extremity of and within said supply air duct.

2. A self-contained air-conditioned enclosure assembly providing a climate controlled environment therein the enclosure assembly comprising:

i) a collapsible self-supporting enclosure, wherein said enclosure includes a roof, four sidewalls extending downwardly from said roof, said sidewalls having an upper portion and a lower portion, an enclosed space, at least one first opening, and the enclosed space is cuboid shaped and is of sufficient size capable of receiving at least one occupant, ii) a plurality of sidewalls, descending from said roof, said sidewalls having two walls sheets and a plurality of spacer strips positioned there between so that spaces are formed between said wall sheets and said spacer strips, and iii) a climate control device connectable to said enclosure, having a climate controlling air to the enclosed space, whereby said enclosure is capable of accepting a slab, said slab having an underside, and defines an enclosed space when erected, said enclosed space is bounded by said roof said slab, and said lower portion of said side walls surround said slab, said slab located within said enclosed space, said sidewalls incorporates said opening and said climate controlling outlet of said climate control device is directly connected to said first opening to supply climate controlled air to said occupant of said enclosed space.

3. The enclosure assembly of claim 2, wherein the enclosure is capable of accepting a slab, said slab having an underside, said slab is of sufficient size capable of receiving at least one occupant and said enclosure further includes:

i) a roof and, ii) four sidewalls extending downwardly from said roof, said sidewalls having an upper portion and a lower portion, whereby the enclosed space is bounded by said roof, said slab when accepted, said lower portion of said side walls surround said slab, said slab located within said enclosed space, and said sidewalls; and said sidewalls incorporates said opening, said opening being capable of receiving the climate controlling outlet of said climate control device.

4. The enclosure assembly of claim 2, wherein the self-supporting enclosure includes a plurality of frame members forming a support structure that supports said roof and said sidewalls, said support structure comprising plurality of frame members.

5. The enclosure assembly of claim 2, wherein the sidewalls are comprised of two transparent plastic sheets having a plurality of spacer strips positioned therebetween so that spaces are formed between said wall sheets and said spacer strips, and wherein the lower portion of said sidewalls are capable of wrapping around to the underside of the accepted slab.

6. The enclosure assembly of claim 2, wherein the enclosure further includes a second opening to exit air from said enclosed space, positioned at a substantially distance from said first opening, and said sidewalls incorporates said second opening, whereby said climate control device is directly connected to said first opening to supply climate controlled air to said enclosed space and said second opening exit air from said enclosed space.

7. The enclosure assembly of claim 2, wherein said climate control device includes:

i) a main housing having four vertical sides, a floor and an interior space, ii) an air plenum located in said main housing, iii) a fresh air chamber having a first open end in communication with said air plenum and a second open end in communication with the surrounding environment and is capable of receiving fresh air from the surrounding environment, whereby said fresh air chamber is otherwise isolated from said interior space of said main housing and is capable of supplying fresh air to said air plenum, iv) a first air moving device located within said air plenum for inducing air movement between said enclosure and said climate control device, v) a first heat transfer means fixed adjacent to said air moving device, whereby air moved by said first air moving device through said first heat transfer means is thermally conditioned, whereby said climate controlling outlet of said climate control device is located adjacent to said first heat transfer means, said climate controlling outlet having an extemity that is connectable to said opening of the enclosure, and a duction structure that directs the thermally conditioned air to said enclosure.

8. The enclosure assembly of claim 7, wherein said climate control device further includes:

i) a filtering device located in said interior space and adjacent to said first air moving device, said filtering device purifies the air moved by said first air moving device, and ii) a control panel connected to at least the first air moving device to control conditioned air delivery to said enclosure.

9. The enclosure assembly of claim 7, wherein said climate control device further includes an exit air duct extending from said main housing, communicating with said air plenum, having an extremity that is connectable to said second opening of the enclosure, said capable of conveying air from said enclosure to said air plenum.

10. The enclosure assembly of claim 7, wherein said climate control device further includes:

i) a compressor chamber located adjacent to said floor of said main housing, having a compressor fixed on said floor, and isolated from said air plenum by the duct structure of said climate control outlet, and ii) a second air moving device fixed adjacent to said compressor chamber.

11. The enclosure assembly of claim 10, wherein said climate control device further includes an exhaust air duct connected to said second air moving device and extends through one of the sides of said main housing preferably on the opposite side of said climate controlling outlet, wherein said exhaust air duct is preferably flexible, collapsible, and light weight round air duct, whereby air moved by said second air moving device is exhausted.

12. The enclosure assembly of claim 7, wherein said climate control device further includes a heat transfer duct, adjacent to said fresh air chamber, having one end communicating with said air plenum and an opposed end connected to said compressor chamber whereby air from said air plenum is exhausted to said compressor chamber.

13. The enclosure assembly of claim 7, wherein said climate control device further includes an air damper pivotally mounted adjacent to said heat transfer duct, mechanically linked to said control panel, and capable of adjusting air flow from said air plenum to said compressor chamber.

14. A method of controlling at least a temperature within a enclosed space capable of receiving at least one occupant, the method comprising the steps of:

i) Erecting a temporary structure, wherein when erected the structure defines the enclosed space, the structure having:

i. a roof, ii. a plurality of sidewalls descending from said roof, said sidewalls having two wall sheets and a plurality of spacer strips positioned there between so that spaces are formed between said wall sheets and said spacer strips, and iii. an inlet opening, and said sidewall incorporating said inlet opening;

ii) coupling an air-conditioning device to the inlet opening, and iii) operating said air-conditioning device, wherein said air-conditioning device delivers conditioned supply air stream to said enclosed space.

15. The method of claim 14, further comprising a method of improving operational efficiency, the method comprises the step of recovering thermal energy at least in part from an exhaust air stream to the supply air stream of said temporary structure.

16. The method of claim 15, wherein the step of recovering thermal energy at least in part from an exhaust air stream includes at least in part transferring heat to said air-conditioning device having a condenser coil.

* * * * *